US006241285B1

(12) United States Patent
Duhr-Kravitz et al.

(10) Patent No.: US 6,241,285 B1
(45) Date of Patent: Jun. 5, 2001

(54) MULTI-POCKET ASSESSMENT FOLDER

(75) Inventors: Susan M. Duhr-Kravitz, Wilmette; Jan M. Southerton, Northbrook, both of IL (US)

(73) Assignee: JSK-4U

( * ) Notice: Subject to any disclaimer, the term of this patent is extended or adjusted under 35 U.S.C. 154(b) by 0 days.

(21) Appl. No.: 09/382,550

(22) Filed: Aug. 25, 1999

(51) Int. Cl.[7] ..... B42D 3/00

(52) U.S. Cl. ..... 281/29; 281/31; 281/37; 402/73

(58) Field of Search ..... 281/29, 31, 37, 281/45; 402/70, 73, 79; 283/56, 23; 229/67.1; 493/947

(56) References Cited

U.S. PATENT DOCUMENTS 5,228,722 * 7/1993 Zoland ..... 283/23
5,487,566 * 1/1996 Hedge, Jr. ..... 283/56
5,873,513 * 2/1999 Ong ..... 281/29 X
5,913,540 * 6/1999 Ong ..... 402/79 X

* cited by examiner

*Primary Examiner*—Willmon Fridie, Jr.
(74) *Attorney, Agent, or Firm*—Alexander Ching

(57) ABSTRACT

A multi-pocket assessment folder is disclosed. The folder comprises an inside portion having a first inside pocket and a second inside pocket. The folder also has an outer portion having a first outside pocket and a second outside pocket. Also included is a vertical fold line. The folder is operable to be folded along the vertical fold line.

4 Claims, 3 Drawing Sheets

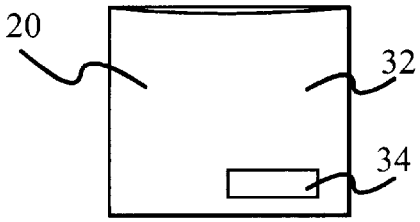
FIG. 3A
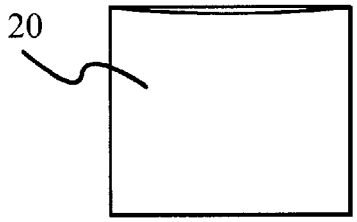
FIG. 3B
FIG. 5
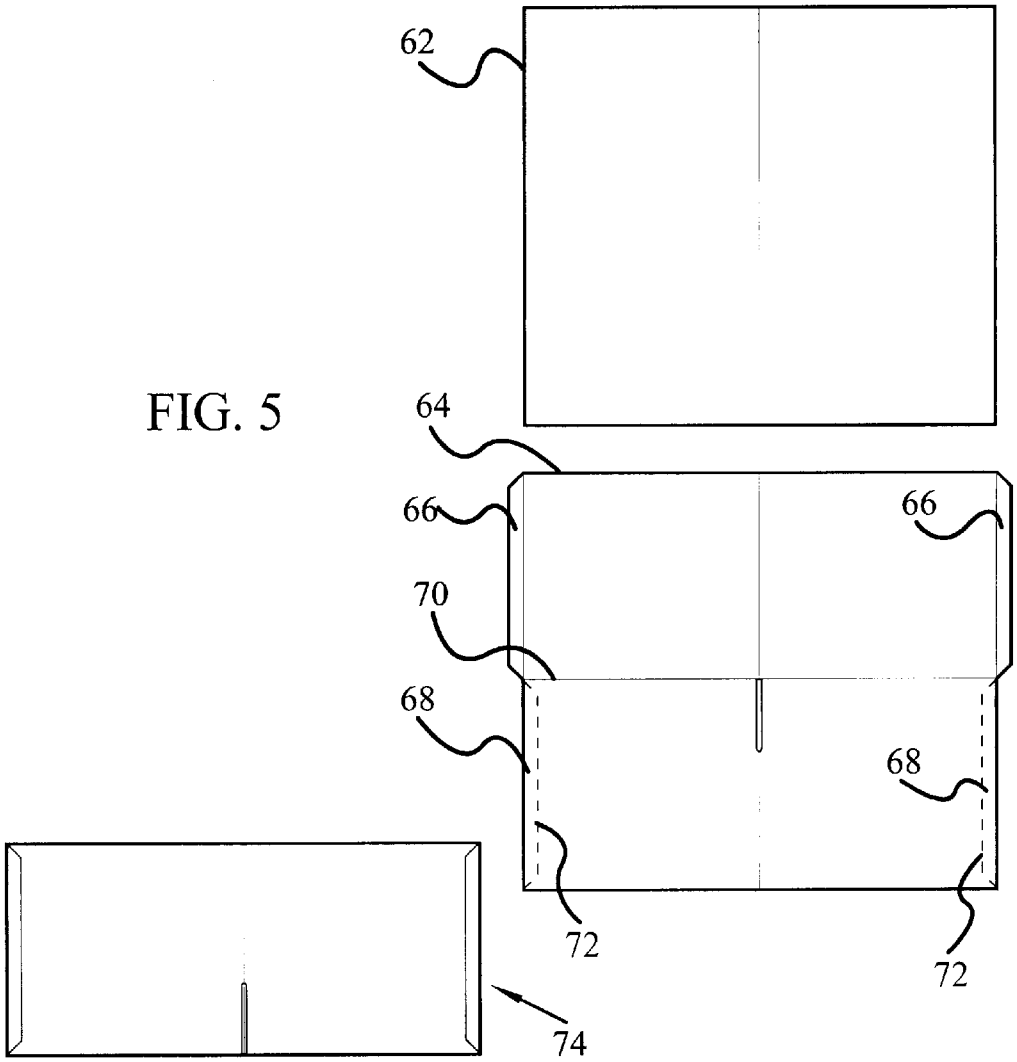

MULTI-POCKET ASSESSMENT FOLDER

TECHNICAL FIELD OF THE INVENTION

This invention relates generally to storage folders and more particularly to a multi-pocket assessment folder.

BACKGROUND OF THE INVENTION

Primary and secondary school students and teachers are often required to keep papers pertaining to daily work, homework and tests in a single location. This enables the instructor to maintain a record of a student's performance over the course of a school year or over several subjects. Current folders, however, are not designed to hold a great deal of material. Additionally, most schools divide the school year into four quarters. Current folders typically have only two pockets. This makes current folders inconvenient for use to track a student's performance over a full year.

SUMMARY OF THE INVENTION

From the foregoing, it may be appreciated that a need has arisen for a multi-pocket assessment folder. In accordance with the present invention a multi-pocket assessment folder is provided which substantially eliminates or reduces the disadvantage and problems associated with current folders.

In one embodiment, a multi-pocket folder is disclosed. The folder comprises an inside portion having a first inside pocket and a second inside pocket. The folder also has an outer portion having a first outside pocket and a second outside pocket. Also included is a vertical fold line. The folder is operable to be folded along the vertical fold line.

A technical advantage of the present invention is that a multi-pocket assessment folder is provided that allows for organizing a students work by quarter. The multi-pocket assessment folder is also able to organize a student's work by subject. Other technical advantages are readily apparent to those skilled in the art from the following drawings, descriptions, and claims.

BRIEF DESCRIPTION OF THE DRAWINGS

For a more complete understanding of the present invention, and for further features and advantages, reference is now made to the following written description taken in conjunction with the accompanying drawings, in which:

FIG. 3*a* and FIG. 3*b* illustrate the folder in a compact configuration;

FIG. 5 is an illustration showing the construction of the folder.

DETAILED DESCRIPTION OF THE INVENTION

Figure 1A:
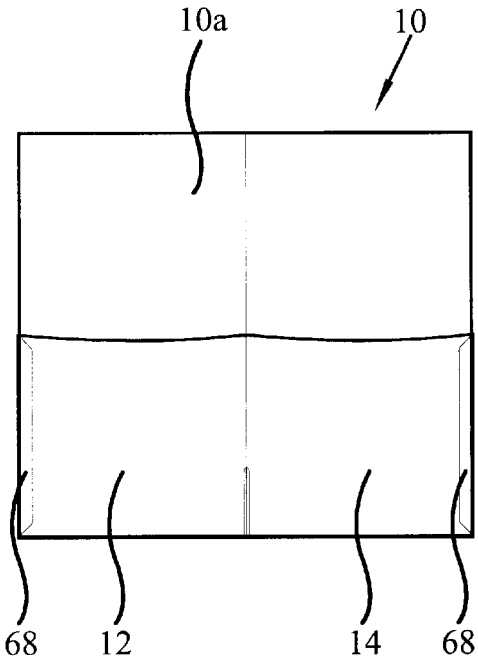
FIG. 1*a* illustrates a view of the present invention showing the inside of the folder.

FIG. 1*a* illustrates a view of the present invention showing the inside 10*a* of folder 10. Illustrated is a first inside pocket 12 and a second inside pocket 14. Inside vertical fold line 17 allows for the folding of folder 10 and will be described in conjunction with FIG. 2. First inside pocket 12 and second inside pocket 14 are designed to hold student papers, exams, projects and other goods. In one embodiment, first inside pocket 12 and second inside pocket 14 are designed to hold paper at least 8½" by 11".

Figure 1B:
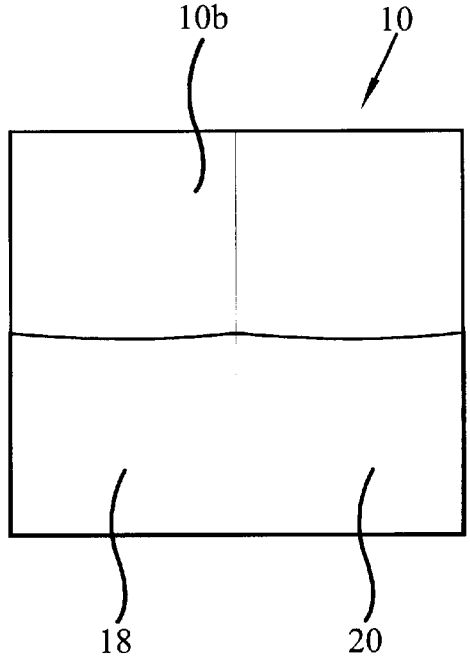
FIG. 1*b* illustrates a view of the present invention showing the outside of the folder.

FIG. 1*b* illustrates a view of the present invention showing the outside 10*b* of folder 10. Illustrated is a first outside pocket 18 and a second outside pocket 20. Vertical fold line 17 allows for the folding of folder 10 and will be described in conjunction with FIG. 2. First outside pocket 18 and second outside pocket 20 are designed to hold student papers, exams, projects and other goods. In one embodiment, first outside pocket 18 and second outside pocket 20 are designed to hold paper at least 8½"by 11".

Folder 10 is preferable manufactured from 175 pound index paper which is also known as tagboard.

Figure 2A:
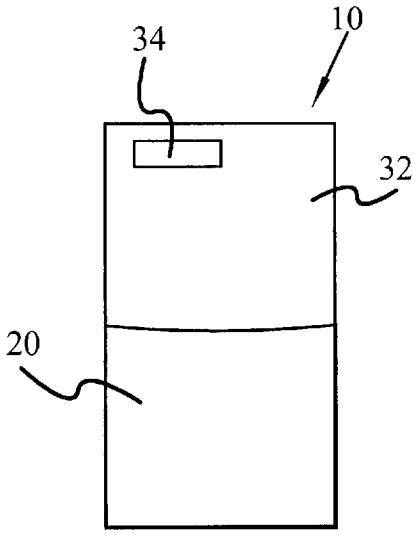
FIG. 2*a* illustrates the configuration formed after folding the configuration of FIG. 1*a*

FIG. 2*a* illustrates the configuration formed after folding the configuration of FIG. 1*a* along vertical fold line 17 by folding first inside pocket 12 towards second inside pocket 14. FIG. 2*a* shows second outer pocket 20 and a top portion 32. Top portion 32 can have optional indicia 34 for identification or decorative purposes. Indicia 34 can be writing, art work, photographs, or any other graphical ornamentation.

Figure 2B:
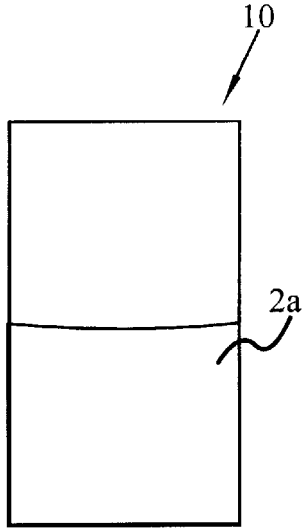
FIG. 2*b* illustrates the other side of the partially folded configuration of FIG. 2*a;*

FIG. 2*b* illustrates the other side of the folded configuration of FIG. 2*a*. FIG. 2*b* shows first outer pocket 18 and top portion 32.

In an alternate embodiment, Top portion 32 is operable to be folded forming a compact configuration of folder 10. This configuration can be held together by fasteners.

FIGS. 3*a* and 3*b* are a front view and a back view of folder 10 in a compact configuration. FIG. 3*a* illustrates the front view of folder 10, showing top portion 32 and any optional indicia 34. FIG. 3*b* illustrates the back view of folder 10, illustrating second outside pocket 20.

Figure 4:
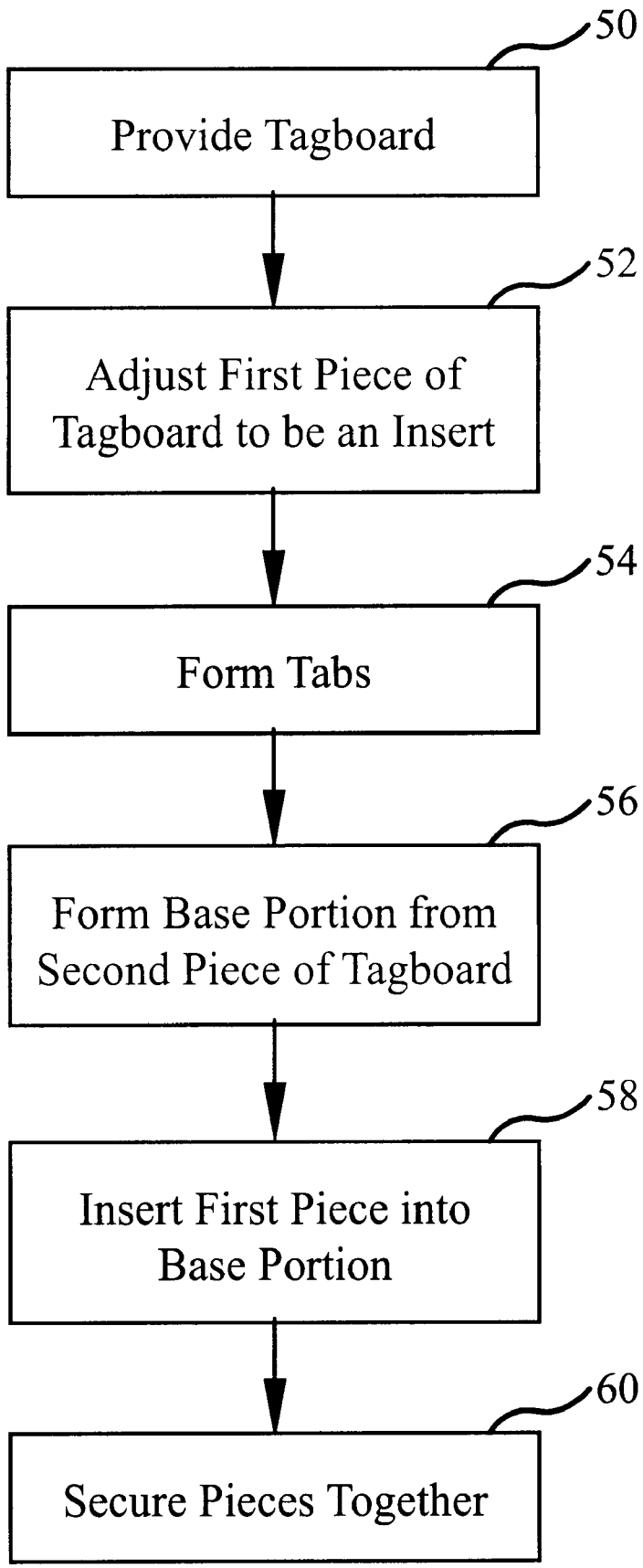
FIG. 4 is a flowchart illustrating the construction of the folder.

FIG. 4 is a flowchart illustrating one way of manufacturing folder 10. In step 50, two pieces of tagboard are provided. In one embodiment, the tagboards are 24 inches long (horizontal) and 18 inches high. In step 52, and referring to FIG. 5, the first piece of tagboard 62 is adjusted to be an insert into the second piece of tagboard 64. In one embodiment, a 1 inch by 18 inch strip is removed from the first piece of tagboard 62, forming a 23 inch by 18 inch piece. In step 54, a ½ inch long by 9 inch high strip 66 is cut from either side of the second piece of tagboard 64, forming two tabs 68 as shown in FIG. 5. In step 56, the second piece of tagboard 64 is folded along a horizontal score line 70 forming a base portion 74. In step 58, the first piece of tagboard 62 is inserted and glued into the base portion 74 of the second piece of tagboard 64. In step 60, the tabs 68 are folded along a score line 72 and glued, securing the second piece of tagboard 64 together, forming folder 10.

Although the present invention has been described in several embodiments, a myriad of changes, variations, alterations, transformations, and modifications may be suggested to one skilled in the art, and it is intended that the present invention encompass such changes, variations, alterations, transformations, and modifications as fall within the spirit and scope of the appended claims.

What is claimed is:

1. A multi-pocket folder having an open configuration and a closed configuration the folder comprising:

an inside portion visible when the folder is in an open configuration having;

a first inside pocket;

a second inside pocket;

a first tab portion located along a side of the first inside pocket and a second tab portion located along a side of the second inside pocket, the first tab portion and the second tab portion securing the first inside pocket and the second inside pocket;

a vertical fold line approximately in the middle of the inside portion and between the first inside pocket and the second inside pocket;

an outside portion defined as the opposite side of the inside portion, having;

a first outside pocket;

a second outside pocket; and wherein the folder is operable to be folded along the vertical fold line by folding the first inside pocket towards the second inside pocket resulting in the folded configuration having a first side and a second side and in which the first outside pocket is visible on the first side and the second outside pocket is visible on the second side.

2. The folder of claim 1, operable to be folded into a compact configuration with one exposed pocket and a top portion.

3. The folder of claim 1, further comprising indicia on the top portion.

4. The folder of claim 3, wherein the compact configuration is secured using fasteners.

* * * * *